United States Patent [19]

Lower

[11] Patent Number: 5,022,198

[45] Date of Patent: Jun. 11, 1991

[54] STAIR EDGE IDENTIFIER

[76] Inventor: J. Donald Lower, 12126 Overcup Dr., Houston, Tex. 77024

[21] Appl. No.: 580,160

[22] Filed: Sep. 10, 1990

[51] Int. Cl.[5] ..... E04B 1/00

[52] U.S. Cl. ..... 52/105; 52/177; 52/179

[58] Field of Search ..... 52/105, 177, 179

[56] References Cited

U.S. PATENT DOCUMENTS

| | | | |
|---|---|---|---|
| 960,489 | 6/1910 | Braun | 52/179 |
| 966,133 | 8/1910 | Staples | 52/179 |
| 1,497,163 | 6/1924 | Van Pyl | 52/179 |
| 4,058,942 | 11/1977 | Naka | 52/179 |

*Primary Examiner*—Richard E. Chilcot, Jr.
*Assistant Examiner*—Joanne C. Downs
*Attorney, Agent, or Firm*—Dodge, Bush, Moseley & Riddle

[57] ABSTRACT

In accordance with an illustrative embodiment of the present invention, a plastic clip-on stair edge identifier includes a channel member having a U-shaped front portion that has front, rear and bottom walls, the rear wall inclining upward and inward toward the front wall, a rearwardly extending flange having its front edge joined to the upper edge of the rear wall of the channel member and inclining downward and rearward therefrom, the identifier being made of a resilient plastic material that is colored red or yellow. The identifier member is clipped from the bottom side onto a rectangular metal bar that provides the front edge of a stair step, and provides a highlight for the front surface of each step to one ascending or descending the stairs.

7 Claims, 1 Drawing Sheet

STAIR EDGE IDENTIFIER

FIELD OF THE INVENTION

This invention relates generally to a means for highlighting the front edge surfaces of stair steps for safety purposes, and particularly to a new and improved clip-on plastic strip that can be readily attached to the front bar of a metal stair to make the front edge of the step highly visible from the front and from above. The strip is constructed in such a way as to be unaffected by foot traffic so that it will remain in place over an extended length of time.

BACKGROUND OF THE INVENTION

Metal stairways commonly are used on offshore drilling rigs and platforms, as well as many ocean going vessels. If the front edge surfaces of the steps are not highlighted in some way so as to be clearly visible, persons using the stairs are apt to stumble and fall and sustain personal injury. For this reason, both U.S Coast Guard and OSHA (Occupational Safety and Health Administration) regulations require that the front edges of such stair steps be made plainly visible. To comply with these regulations in the past, the front edges of the metal stair steps have been painted or taped a bright color. However, with foot traffic and weathering, paint and the like peels and chips off to create a hazardous and highly undesirable situation.

The general object of the present invention is to provide a new and improved stair edge identifier that is long lasting, economical to manufacture and unaffected by foot traffic.

Another object of the present invention is to provide a new and improved stair edge identifier in the form of a elongated, plastic member that clips onto the front edge of a metal step in a manner such that it is readily visible from both the front and the top of the step, but is not engaged by the foot of a person who ascends or descends the steps.

SUMMARY OF THE INVENTION

These and other objects are attained in accordance with the concepts of the present invention through the provision of a clip-on, colored identifier for the front bar of a metal stair step. The strip has a front portion with the general shape of a "U", and a rear portion in the form of a flange that is joined to the upper edge of the rear wall of the front portion and inclines rearwardly and downward thereof. The front portion of the strip member is formed so that the upper edges of the front and rear walls thereof are spaced apart, in a relaxed state, by a lesser distance than the width of the lower wall. To slide the front portion upward onto the front bar of the step, such upper edges must be spread apart somewhat, and the resilient nature of the member cause the front and rear walls to firmly grip the bar. The fact that the rear portion of the member is inclined makes it plainly visible from above, and causes it to shed water or any other liquids that might fall upon it.

BRIEF DESCRIPTION OF THE DRAWINGS

The present invention has other objects, features and advantages which will become more clearly apparent in connection with the following detailed description, taken in conjunction with the appended drawings in which.

DETAILED DESCRIPTION OF A PREFERRED EMBODIMENT

Figure 1:
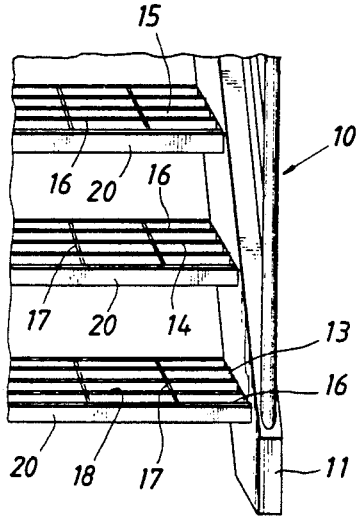
FIG. 1 is a fragmentary front view of a metal stairs showing identifier strips in accordance with the present invention secured to the front bars of the steps.

Referring initially to FIG. 1, a metal stairs indicated generally at 10 of the type typically found on marine structures such as drilling rigs, production platforms, and other water going vessels includes side members 11 having steps 13–15 extending therebetween. Each step resembles a grate having a plurality of rectangular, transversely arranged bars 16 that are joined by a plurality of rods 17 that extend front to rear, and which are welded to the bars 16 at all points of intersection. Each bar 16 can have serrations or teeth on its upper edge to provide improved traction with the shoe of a user. For a typical metal stair having a total width of three (3) feet, the length of each of the bars 16 is about 34 inches. Each bar, including the front bar, has a vertical height of about $\frac{3}{4}$ of an inch, and a thickness of about $\frac{1}{4}$ of an inch.

Figure 2:
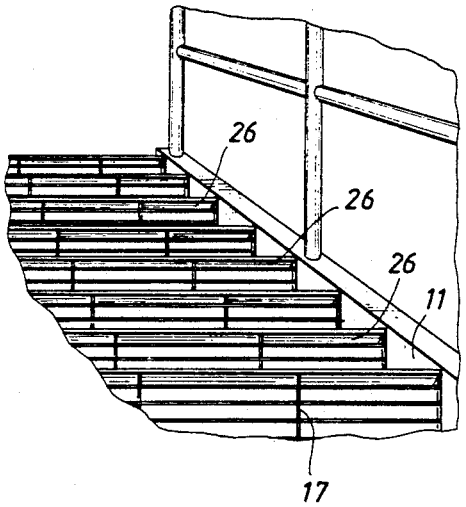
FIG. 2 is a view similar to FIG. 1 but showing the stair steps from above.

As shown in FIG. 1, an identifier strip 20 constructed in accordance with the present invention clips onto the front bar 16 of each step, so as to clearly identify the front upper edge thereof. As shown in FIG. 2, a rear flange (26) on each of the strips 20 also make it visible from above to a person who is descending the stairs.

Figure 3:
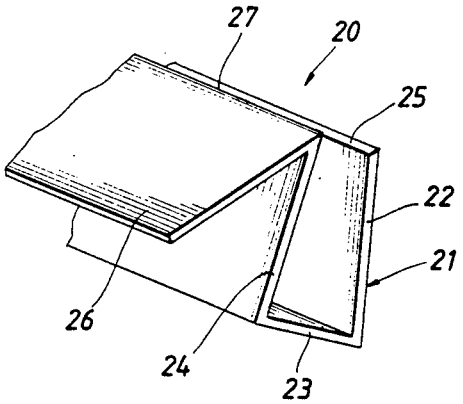
FIG. 3 is an isometric fragmentary view of an identifier strip member to illustrate the relaxed cross-section thereof.

With reference to FIG. 3, the strip member 20, which is made of a suitable resilient, brightly colored, plastic material, has a generally U-shaped front portion 21 that includes a front wall 22, a bottom wall 23 and a rear wall 24. These wall each have a thickness of about 0.003 inch. The front and bottom walls 22 and 23 preferably are formed at a right angle to one another, however the rear wall 24, in the relaxed state of the strip 20, inclines upward and inward toward the upper edge 25 of the front wall 22 so as to leave a gap at the top of about $\frac{1}{8}$ of an inch, the acute angle between the bottom and rear walls being about 60°. The front wall 22 has a height of about $\frac{3}{4}$ of an inch, and the bottom wall 23 is about 5/16 of an inch wide. The inclined rear wall 24 can have a height that is slightly greater than the height of the front wall 22, as shown. The rear portion or flange 26 of the member 20 has its upper edge 27 joined to the upper edge of the rear wall 24 and inclines rearward and downward at an angle of about 45° with respect to the plane of the rear wall 24. The rear portion of flange 26 also has a thickness of about 0.003 inch.

Figure 4:
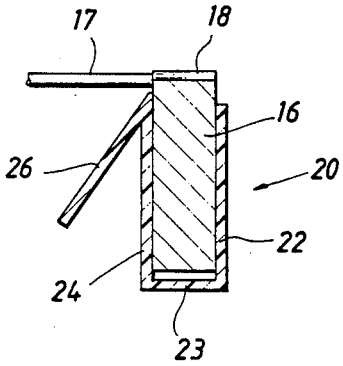
FIG. 4 is a side sectional view showing the identifier strip in position on the front bar of a metal stair step.

In use, a clip member 20 is attached to the front bar (16) of each metal stair step as shown in FIG. 4. The top edges of the front and rear walls 22 and 24 are spread slightly apart, and then the member is slid from below upward onto the front bar 16 until the bottom wall 23 is near, if not up against, the bottom surface of the bar. The resilient nature of the plastic material causes the walls 22 and 24 to resile toward each other and tightly grip the bar 16 to retain the strip member 20 firmly in place. The rear flange 26 of the strip member 20 inclines downward and rearward at the acute angle mentioned above so as to be plainly visible to a person descending the stairs. The inclined flange 26 also serves to run off water or other liquids that fall on the stairs from above.

The strip members 20 preferably are made of a plastic that has a bright color, such as yellow or red. Since the upper edges of the walls 22 and 24 are located below the tread surfaces of the steps, the members 20 are unaffected by foot traffic and cannot readily be knocked or pushed off. The strip members 20 will not wear or peel off like paint or tape, and thus provide an essentially permanent solution to the problem of stair step edge identification. The strips can be manufactured in long lengths and cut off to fit a particular application, and are quite inexpensive to make. Installation is rather simple, and does not require any tools whatsoever.

Since certain changes or modifications may be made in the disclosed embodiment without departing from the inventive concepts involved, it is the aim of the appended claims to cover all such modifications and changes falling within the true spirit and scope of the present invention.

What is claimed is:

1. An identifier strip member adapted to the positioned on the front of a stair step having a vertically arranged, rectangular metal bar at the front side thereof, comprising; a channel member made of a resilient plastic material, said member having front portion with a general "U" shape that includes front, rear and bottom walls, and a rear portion that is substantially planar and joined to the upper edge of said rear wall, said rear wall inclining upward toward said front wall so that the respective upper edges of said front and rear walls must be spread apart to position said member on the front bar of said step, the spreading apart of said edges causing said front and rear walls to firmly grip said bar to retain said member thereon, said front wall being plainly visible from the front of said stair step and said rear portion being plainly visible from above said stair step to thereby provide a user of the stairs with a clear identification of the front edge of each stair step.

2. The member of claim 1 wherein said rear portion is formed in a plane that inclines rearward and downward with respect to the plane of said rear wall to promote run-off of liquids therefrom.

3. An article for use in identifying the front edge of a stair step having a rectangular metal bar defining the front surface thereof, comprising; an elongated plastic member adapted to be positioned on said bar and substantially cover the front, rear and lower sides thereof, said member being made of a resilient plastic material having distinctive color, said member including a front portion having a "U" shaped section providing a front wall and a rear wall joined together by a bottom wall, said front wall extending upward at a right angle to said bottom wall, said rear wall extending upward at an acute angle to said bottom wall, so that the distance between the upper edges of said front and rear walls is initially less than the width of said bottom wall when said front portion is in a relaxed state, said member having a rear portion comprising a rearwardly extending flange having a forward edge, said forward edge being joined to the upper edge of said rear wall, whereby the said upper edges of said front and rear walls must be expanded to enable said member to be sliped onto said bar from the bottom side thereof, the resilience of said member causing said front and rear walls to grip said bar to affix said member thereto in a position such that said front wall is clearly visible from the front of said stair step and said flange is clearly visible from above said stair step.

4. The article of claim 3 wherein said flange extends at an acute angle to said rear wall so as to incline downward and rearward when said front portion is affixed to said bar.

5. The article of claim 4 wherein said front wall has a lesser height than said rear wall so that the upper edge of the joint between said flange and said rear wall is higher than the upper edge of said front wall.

6. The article of claim 4 when said acute angle between said flange and said rear wall is about 45°.

7. The article in claim 3 when said acute angle between said rear wall and said bottom wall is about 60°.

* * * * *